US012584397B2

(12) United States Patent
Abbad et al.

(10) Patent No.: US 12,584,397 B2
(45) Date of Patent: Mar. 24, 2026

(54) METHOD AND DOWNHOLE APPARATUS FOR MATRIX ACIDIZING OF A SUBTERRANEAN ROCK FORMATION

(71) Applicant: SCHLUMBERGER TECHNOLOGY CORPORATION, Sugar Land, TX (US)

(72) Inventors: Mustapha Abbad, Dhahran (SA); Gallyam Aidagulov, Dhahran (SA); Hussain Khalifah Al-Dakheel, Dammam (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/993,672

(22) PCT Filed: Jul. 13, 2022

(86) PCT No.: PCT/US2022/036971
§ 371 (c)(1),
(2) Date: Jan. 13, 2025

(87) PCT Pub. No.: WO2024/015057
PCT Pub. Date: Jan. 18, 2024

(65) Prior Publication Data
US 2026/0015928 A1 Jan. 15, 2026

(51) Int. Cl.
*E21B 43/27* (2006.01)

(52) U.S. Cl.
CPC ..... *E21B 43/27* (2020.05)

(58) Field of Classification Search
CPC ..... E21B 43/27; E21B 41/0078
See application file for complete search history.

(56) References Cited

U.S. PATENT DOCUMENTS

| | | | | |
|---|---|---|---|---|
| 3,393,736 | A | 7/1968 | Goodwin | |
| 2003/0234106 | A1* | 12/2003 | Surjaatmadja | E21B 43/114 166/308.1 |
| 2014/0047915 | A1 | 2/2014 | Maute et al. | |
| 2014/0231546 | A1* | 8/2014 | Etschel | E21B 37/06 239/245 |
| 2020/0256174 | A1* | 8/2020 | Alruwaili | E21B 33/124 |
| 2022/0042409 | A1* | 2/2022 | Sidaoui | E21B 43/27 |
| 2023/0235656 | A1* | 7/2023 | Ali | E21B 43/27 166/307 |

FOREIGN PATENT DOCUMENTS

| | | | | |
|---|---|---|---|---|
| WO | 2021034914 | A1 | 2/2021 | |
| WO | WO-2021158280 | A1 * | 8/2021 | E21B 43/27 |

OTHER PUBLICATIONS

International Search Report and Written Opinion of International Patent Application No. PCT/US2022/036971 dated on Apr. 6, 2023, 14 pages.

* cited by examiner

*Primary Examiner* — James G Sayre
(74) *Attorney, Agent, or Firm* — Jeffrey D. Frantz

(57) ABSTRACT

The present disclosure relates to downhole tools and related methods that provide for controlled radial movement of one or more nozzles to provide an adjustable and variable standoff between the exit of the nozzle(s) and the wellbore surface in the treatment zone of a wellbore during matrix acidizing.

18 Claims, 6 Drawing Sheets

METHOD AND DOWNHOLE APPARATUS FOR MATRIX ACIDIZING OF A SUBTERRANEAN ROCK FORMATION

CROSS-REFERENCE TO RELATED APPLICATION

This application is a National Stage Entry of International Application No. PCT/US2022/036971, filed Jul. 13, 2022.

FIELD

The subject disclosure relates to matrix acidizing operations that enhance recovery of hydrocarbons from subterranean rock formations.

BACKGROUND

The rate of hydrocarbon recovery from hydrocarbon-bearing subterranean rock formations (i.e., hydrocarbon reservoirs) is governed by the interplay of viscous and capillary forces that determine fluid transport in porous media, and several enhanced recovery techniques have been devised to increase the rate and completeness of fluid transport. One type of enhanced recovery technique is commonly referred to as matrix acidizing, which involves the supply or injection of fluidic chemical agents such as acids and other materials into the near-wellbore area of a hydrocarbon-bearing subterranean rock formation at pressures below formation fracture pressure to restore or enhance the permeability of the rock formation. The matrix acidizing is often carried out following damage to the near-wellbore area following drilling and fracturing operations. As the fluidic chemical agent (referred to herein as a "stimulating fluid") contacts the rock formation at a treatment site or zone, formation rock (often carbonates) at or near the treatment site or zone can react to the stimulating fluid and undergo dissolution reactions that produce highly permeable channels or "wormholes" that enable fluid transport through the rock formation. Successful matrix acidizing is often characterized by the production of dominant wormholes that may have some degree of branching but extend into the rock formation and consume minimal amounts of stimulating fluid.

In the current practice, coiled tubing is used to carry the stimulating fluid from the surface to the downhole target zone of the wellbore where it exits the coiled tubing radially through several nozzles located at the bottom part of the coiled tubing.

In order to control the wormhole placement and accelerate its initiation, the velocity of the jet of stimulating fluid at the impingement point on the surface of the wellbore should exceed a certain threshold. This allows the stimulating fluid to create a small cavity or notch from which the dominant wormholes will be initiated. However, the coiled tubing operator does not have direct control of the jet velocity of the stimulating fluid at the impingement point because the injection flow rate, and hence the jet velocity at the impingement point, is constrained by the formation type and the maximum working pressure at which the stimulating fluid can be injected to avoid fracturing the rock.

Furthermore, even though the jet velocity might be high at the exit of the nozzle, it is known to decrease dramatically along the distance between the exit of the nozzle and the impingement point. This distance is typically referred to as the standoff. If the standoff is large, the jet velocity at the impingement point might not be able to generate the desired fast wormholing.

SUMMARY

In embodiments, a downhole tool is provided that is deployable in a wellbore that traverses a subterranean rock formation. The downhole tool can be used to stimulate recovery of hydrocarbons from the rock formation. The downhole tool can be deployed at a treatment zone of the wellbore. The downhole tool includes a nozzle supported by at least one moveable arm, wherein the nozzle is configured to inject a stimulating fluid into the near-wellbore area of the rock formation at a pressure below the formation fracturing pressure. The nozzle can be configured to direct a high-pressure flow of the stimulating fluid to a localized area of the wellbore surface in the treatment zone to form at least one wormhole arising from the dissolution of rock caused by the reaction of the rock with the stimulating fluid. The at least one moveable arm can be configured for controlled radial movement of the nozzle to provide an adjustable and variable standoff between the exit of the nozzle and the wellbore surface in the treatment zone.

In embodiments, the downhole tool can include flexible tubing that is external to the at least one moveable arm and configured to carry stimulating fluid to the nozzle.

In embodiments, the downhole tool can include packers spaced apart from one another and configured to isolate the treatment zone.

In embodiments, the downhole tool can be conveyed by coiled tubing.

In embodiments, the downhole tool can include a sliding body that is operably coupled to the at least one moveable arm, wherein linear translation of the sliding body drives pivoting movement of the at least one arm that produces radial movement of the nozzle to provide the adjustable and variable standoff between the exit of the nozzle and the wellbore surface in the treatment zone.

In embodiments, the downhole tool can be configured such that the linear translation of the sliding body is adjusted by electromechanical operation or hydraulic operation.

In embodiments, the electromechanical operation or hydraulic operation of the downhole tool that adjusts the linear translation of the sliding body can be controlled by electric power cables or hydraulic lines that extend from a surface facility to the downhole tool via tubing.

In embodiments, the electromechanical operation or hydraulic operation of the downhole tool that adjusts the linear translation of the sliding body can be powered by a tool battery and controlled by signals communicated over a fiber optic cable that extends from a surface facility to the downhole tool via tubing.

In embodiments the downhole tool can be configured to employ pressure that results from supply of stimulating fluid to the downhole tool as a pressure source for hydraulic operation of the downhole tool that adjusts the linear translation of the sliding body.

In embodiments, the downhole tool can include a plurality of nozzles supported by at least one moveable arm, wherein each nozzle is configured to direct a high-pressure flow of stimulating fluid to a localized area of the wellbore surface to create a plurality of wormholes arising from dissolution of rock caused by reaction of the rock with the stimulating fluid. The at least one moveable arm can be configured for controlled radial movement to provide adjustable and variable standoff between the exits of the plurality of nozzles and the wellbore surface in the treatment zone.

In embodiments, the plurality of nozzles can be supported by a plurality of moveable arms.

In embodiments, the nozzle(s) and the at least one arm can be part of a jetting module that rotates about the central axis of the downhole tool to achieve 360-degree matrix acidizing stimulation.

In embodiments, the nozzle(s) and the at least one arm can be part of several jetting modules that are spaced axially relative to one another along the tubular housing of the downhole tool.

In embodiments, the nozzle(s) and the at least one arm can be part of a jetting module that is configured to move axially relative to the central axis of the tool.

In another aspect, a method is provided for stimulating recovery of hydrocarbons from a subterranean rock formation traversed by a wellbore, which involves deploying the downhole tool at a treatment zone of the wellbore. The at least one moveable arm of the downhole tool is configured for controlled radial movement of the nozzle to provide a desired standoff between the exit of the nozzle and the wellbore surface in the treatment zone. The downhole tool is operated to supply a stimulating fluid to the treatment zone at a pressure less than formation breakdown pressure, wherein the nozzle directs a high-pressure flow of the stimulating fluid from the exit of the nozzle to a localized area of the wellbore surface in the treatment zone to form at least one wormhole arising from the dissolution of rock caused by the reaction of the rock with the stimulating fluid.

In embodiments, the stimulating fluid can include an acid component.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

The subject disclosure is further described in the detailed description below, in reference to the noted plurality of drawings by way of non-limiting examples of the subject disclosure, in which like reference numerals represent similar parts throughout the several views of the following drawings, and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Matrix acidizing involves the injection or supply of stimulating fluid (e.g., hydrochloric acid) into the near-wellbore area of a hydrocarbon-bearing subterranean rock formation at a pressure below the formation fracturing pressure. As the stimulating fluid contacts the subterranean rock formation at a treatment site or zone, the formation rock (often carbonates) at or near the treatment site or zone can react to the stimulating fluid and undergo dissolution reactions that produce highly permeable channels or "wormholes" that extend radially (i.e., in a direction with a radial component orthogonal to the central axis of the wellbore) through the rock formation and enable fluid transport through the rock formation, which can restore or enhance the permeability of the rock formation.

In embodiments, the process that forms such wormholes at a treatment site or zone can be logically partitioned into two time periods: an induction time period and a wormholing time period. The induction time period is the time from the first injection of the stimulating fluid to initiate one or more wormholes at the treatment site or zone. The wormholing time period is the time period that one or more wormholes propagate by further dissolution of the formation rock and extend radially into the rock formation. The volume of stimulating fluid injected during the induction time period can be greater than thirty percent of the total volume required for the matrix acidizing operations. Hence, minimizing the induction time period can significantly reduce the time and cost of matrix acidizing operations.

In the subject disclosure, a method and a downhole tool are described. The method and downhole tool provide for adjustment and control of standoff between the exit of a nozzle and the surface of the wellbore. As a result, the velocity of the jet of stimulating fluid at the impingement point on the surface of the wellbore can be adjusted and controlled to increase the probability to place the wormhole in the designed location and also minimize the amount of stimulating fluid used to form the wormhole.

Figure 1:
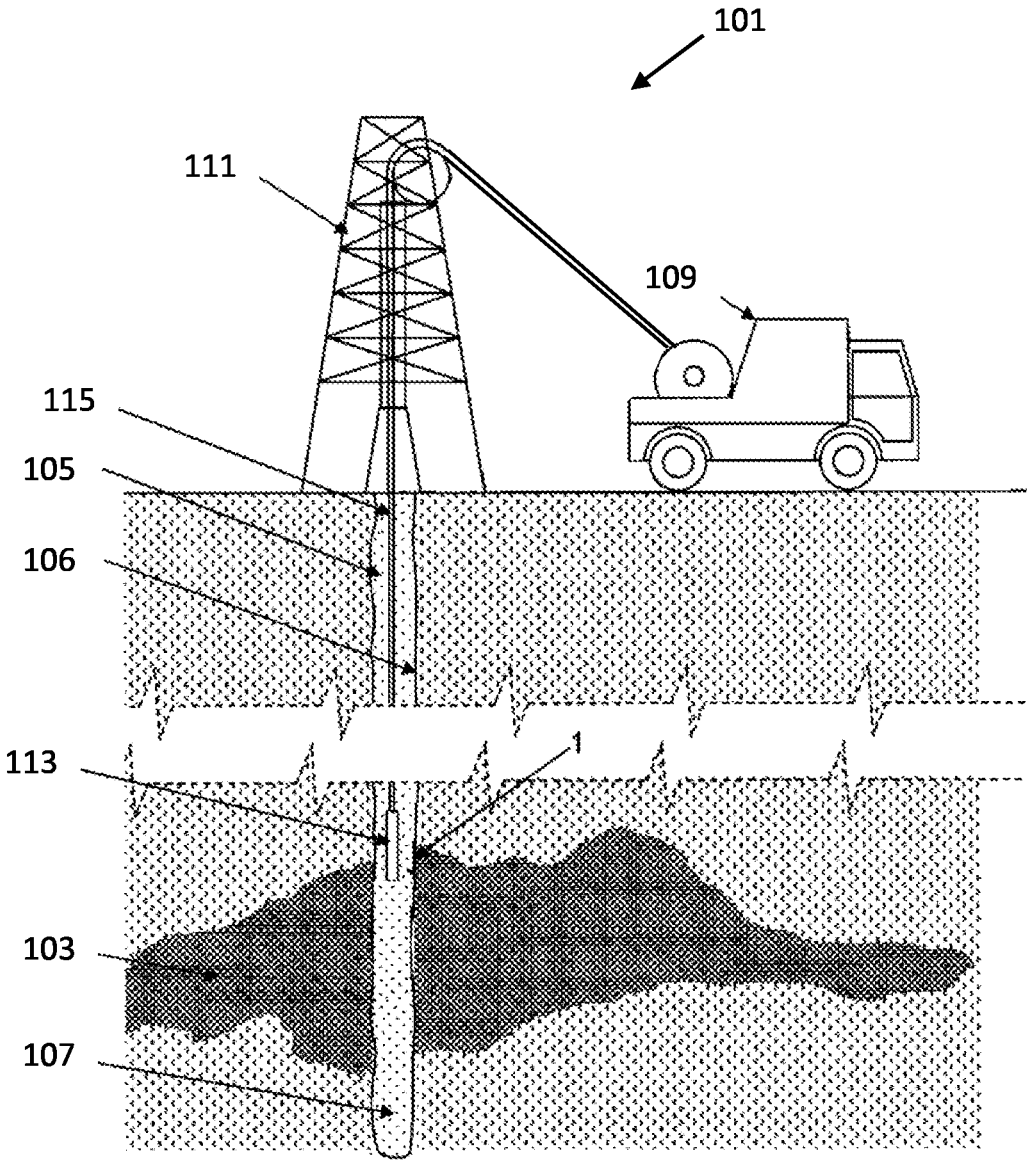
FIG. 1 is a schematic diagram of a wellsite with equipment provided for matrix acidizing a subterranean rock formation according to an embodiment of the present disclosure.

FIG. 1 is a schematic diagram that illustrates an example onshore hydrocarbon well location with surface equipment 101 above a hydrocarbon-bearing subterranean rock formation 103 after a drilling operation has been carried out. At this stage, the wellbore 105 is filled with a fluid mixture 107 which is typically a mixture of drilling fluid and drilling mud. In subsequent stages, the well is typically completed by running one or more casing strings in the wellbore 105 before cementing operations that cement the casing string(s) to the wellbore surface 106. In this example, the surface equipment 101 comprises a surface unit 109 and rig (or injector) 111 for deploying a downhole tool 113 in the wellbore 105. The surface unit 109 may be a vehicle coupled to the downhole tool 113 by coiled tubing 115 (or possibly other tubing). Furthermore, the surface unit 109 can include an appropriate device for determining the depth position of the downhole tool 113 relative to the surface level.

Figure 2:
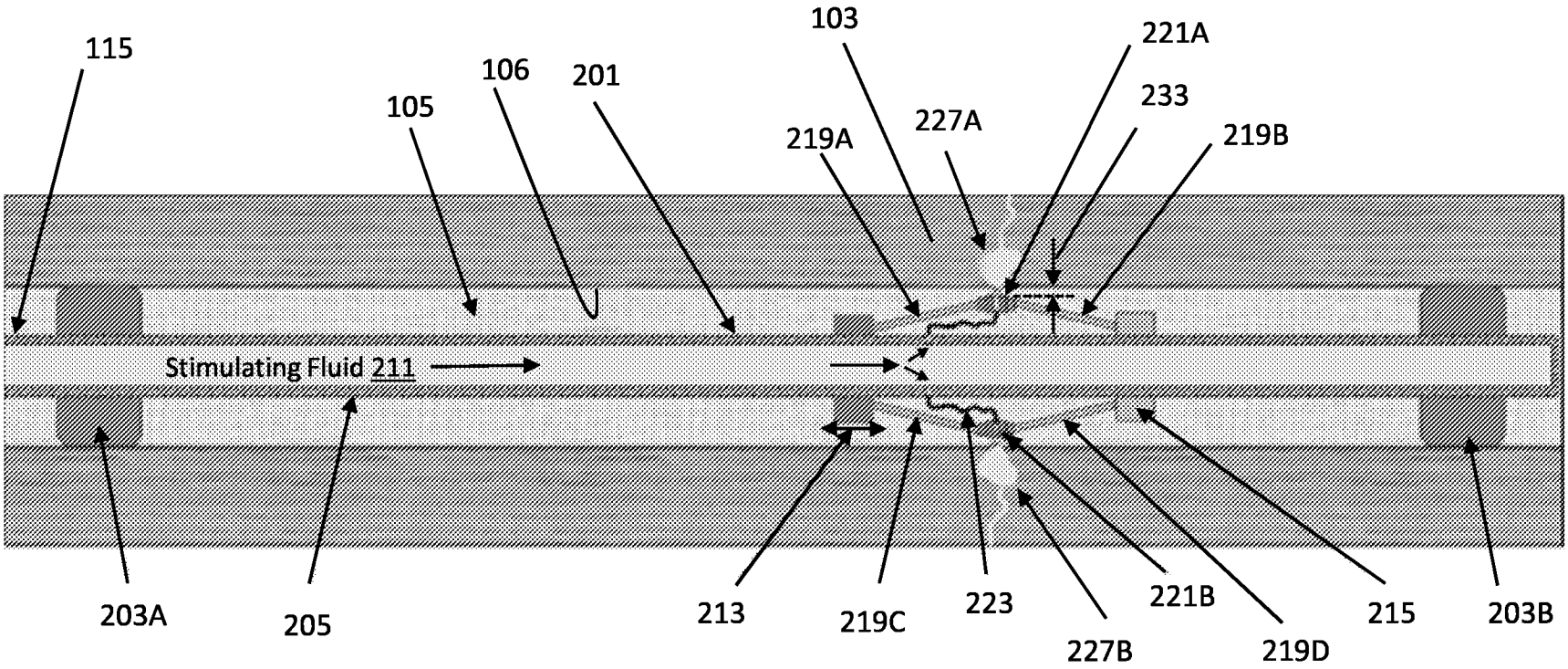
FIG. 2 is a schematic diagram of an illustrative downhole tool for matrix acidizing a subterranean rock formation according to an embodiment of the present disclosure.

In one embodiment illustrated in FIG. 2, the downhole tool 113 includes a bottom hole assembly (BHA) 201 supported by a connection (not shown) to the tubing 115. The BHA 201 includes one or more packers 203A disposed at or near the connection to the tubing 115. A tool housing 205 extends axially away from the connection to the tubing 115 to a dummy tail that supports one or more packer(s) 203B. In this manner, the one or more packers 203A are spaced axially from the one or more packers 203B. As the BHA 201 is run in the wellbore 105, the packers 203A, 203B can be activated to contact the wellbore surface 106 to isolate a treatment zone of the wellbore 105, which is the annular space of the wellbore 105 between the packer(s) 203A and the packer(s) 203B.

The tool housing 205 has a central channel that is in fluid communication with the interior tubular channel of the tubing 115. During operations, stimulating fluid 211 is pumped from the surface by the surface equipment 101 through the interior tubular channel of the tubing 115 and into the central channel of the tool housing 205.

The tool housing 205 further supports a plurality of arms (e.g., four shown as 219A, 219B, 219C, and 219D) that are disposed about the exterior surface of the tool housing 205 between the packer(s) 203A and the packer(s) 203B. The plurality of arms (e.g., 219A, 219B, 219C, and 219D) support a plurality of nozzles (e.g., two shown as 221A, 221B) such that the plurality of arms and the plurality of nozzles are operably disposed in the treatment zone of the wellbore 105. The arms 219A, 219B, 219C, 219D are configured to move the nozzles 221A, 221B radially away from the tool housing 205 toward the wellbore surface 106 (and also for opposite radial movement away from the wellbore surface 106 toward the tool housing 205) by linear actuation provided by a sliding body 213 spaced from a fixed body 215 on the exterior surface of the tool housing 205. Arm 219A couples the sliding body 213 to one side of nozzle 221A, and arm 219B couples the other side of nozzle 221A to the fixed body 215. Similarly, arm 219C couples the sliding body 213 to one side of nozzle 221B, and arm 219D couples the other side of nozzle 221B to the fixed body 215. In this configuration, linear translation of the sliding body 213 on the exterior surface of the tool housing 205 in the direction toward the dummy tail of the BHA 201 can be configured to pivot the arms away from the exterior surface of the tool housing 205 and move the nozzles 221A, 221B radially away from the tool housing 205 toward the wellbore surface 106. Furthermore, linear translation of the sliding body 213 on the exterior surface of the tool housing 205 in the opposite direction away from the dummy tail of the BHA 201 can be configured to pivot the arms inward toward the exterior surface of the tool housing 205 and move the nozzles 221A, 221B radially inward away from the wellbore surface 106 and toward tool housing 205. The direction and magnitude of the linear translation of the sliding body 213 can be controlled to control the radial movement of the nozzles 221A, 221B and provide an adjustable and variable standoff between the exits of the respective nozzles 221A, 221B and the wellbore surface 106 in the treatment zone. For example, the standoff between the nozzle 221A and the wellbore surface 106 is illustrated by arrows 233 as shown.

Note that when the BHA 201 is deployed in the treatment zone of the wellbore, the arms 219A, 219B, 219C, 219D can be configured in a neutral position extending parallel to the tool housing 205 along the exterior surface of the tool housing 205 to avoid the BHA 201 being stuck during such deployment.

In embodiments, the linear translation motion of the sliding body 213 of the BHA 201 can be generated and controlled by an electrical motor or hydraulic solenoid powered from the surface via electrical cabling or hydraulic line(s) disposed inside the tubing 115. As a result, the movement of the arms can be controlled to place the nozzles 221A, 221B at a designed standoff.

In other embodiments, such as for applications that do not deploy acid-proof power cables that can sustain the high injection pressures, a fiber optic cable can be used to transfer control signals to the tool housing 205 while the electrical motor or hydraulic solenoid of the tool is powered by a battery (e.g., lithium-ion battery) that is supported by the tool housing 205. In this case, a control signal can be sent to the downhole tool via the fiber optic cable to trigger the electrical motor or hydraulic solenoid that is connected to the tool battery and moves the sliding body 213. To conserve power, a temporary stopper can hold the sliding body 213 from returning back.

In other embodiments, the BHA 201 can employ more than one sliding body to control the radial movement of the multiple nozzles independently from one another. This configuration can provide adjustable and variable standoff between the exits of the multiple nozzles and the wellbore surface in the treatment zone that can be controlled independently from one another.

In embodiments, the jetting nozzles 221A, 221B can be placed at the junction between the arms. During the pivoting movement of the arms, each nozzle can be configured to move radially (without any pivoting movement) due to articulations or joints made in the body of the nozzle.

In embodiments, the stimulating fluid 211 exits the central channel of the tool housing 205 through flexible tubing 223 connected to the inlets of the respective jetting nozzle 221A, 221B as shown. The flexible tubing 233 is external to the arms and configured to carry stimulating fluid to the inlets of the respective nozzles 221A, 221B. The flexibility of the tubing 223 can allow for free motion of the arms with minimal tension applied to the flexible tubing 223 and the arms.

Once the BHA 201 is deployed in the treatment zone of the wellbore 105, and the standoff of the nozzle(s) is adjusted by the operator or control system as per job design, the injection of the stimulating fluid can be started to inject the stimulating fluid into the near-wellbore area of the rock formation at a pressure below the formation fracturing pressure. During such injection, the nozzle(s) of the BHA 201 direct a high-pressure flow of the stimulating fluid to a localized area of the wellbore surface in the treatment zone to form one or more wormholes arising from the dissolution of rock caused by the reaction of the rock with the stimulating fluid. Two wormholes labeled 227A, 227B are shown in FIG. 2. Once the stimulation of the treatment zone is completed, the arms can be retracted into their neutral position close to the tool housing by moving the sliding body 213. As a result, the tubing 115 can be pulled out freely to position the BHA 201 to stimulate another treatment zone of the wellbore 105.

In other embodiments, the BHA can be adapted to employ only one pivoting arm.

In still other embodiments, the BHA can be configured with several nozzles placed on each arm, and only the ones needed for a particular job are configured in an open state of use for the particular job. The others can be plugged mechanically on the surface, or downhole by the means of sliding sleeves to close the connection between the tubing and the nozzle (or the flexible tubing connecting the central channel of the tool housing 205 with the nozzle).

Figure 3:
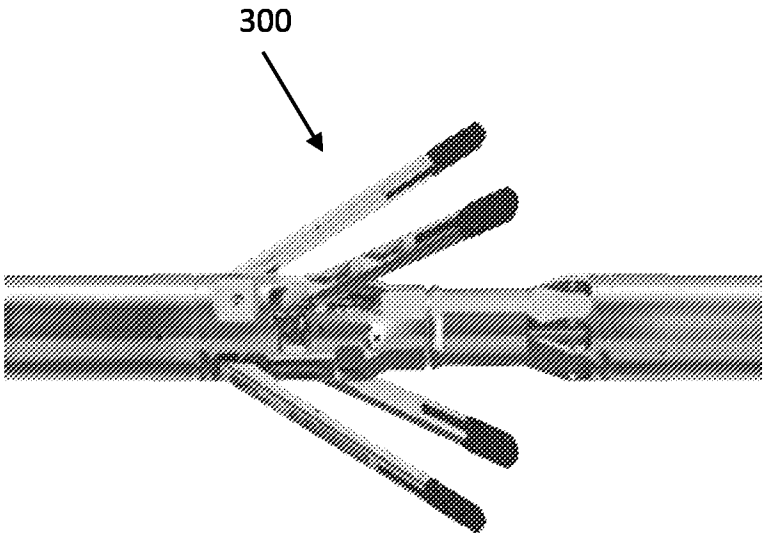
FIG. 3 is a diagram of a mechanical caliper module that can be integrated and used as part of the downhole tool of FIG. 2.

In other embodiments, the BHA can be equipped with a mechanical caliper module for measuring the standoff of the nozzle(s). An example mechanical caliper module 300 is shown in FIG. 3, which employs a set of four spring-loaded caliper arms that can pivot away from the tool housing and contact the wellbore surface. The magnitude of such pivoting movement can be used to determine the radial offset between the tool housing and the wellbore surface. The radial position of the nozzle(s) relative to the tool housing can be determined from the linear translation of the sliding body (relative to the position of the sliding body in the neutral position of the arms) and the resulting pivoting movement of the arms of the BHA. Then, the radial offset of the tool housing relative to the wellbore surface together with the radial position of the nozzle(s) relative to the tool housing can be used to determine the standoff of the nozzle(s).

In embodiments, the standoff of the nozzle(s) can be communicated to the operator or control system located at the surface, so that the nozzle standoff can be adjusted precisely in accordance with the job design.

In other embodiments, the system can omit any control or power cables that connect the BHA to the surface and power the articulation of the arms. Instead, the arms of the BHA can be actuated fully hydraulically (e.g., by hydraulic cylinders) as the pressure inside the BHA increases during jetting operation. In this case, the hydraulic actuator (e.g., hydraulic cylinder) can be configured to receive pressure from the BHA and moves the arms (for example, against a spring to the limit position which can be predefined on the surface by adjusting stoppers and knowing the wellbore diameter). Once the jetting is completed, the pressure inside the BHA is reduced and so the pressure inside the hydraulic actuator is reduced to permit the arms to retract to their neutral position to permit the tool to be moved to another location in the wellbore.

Figure 4A:
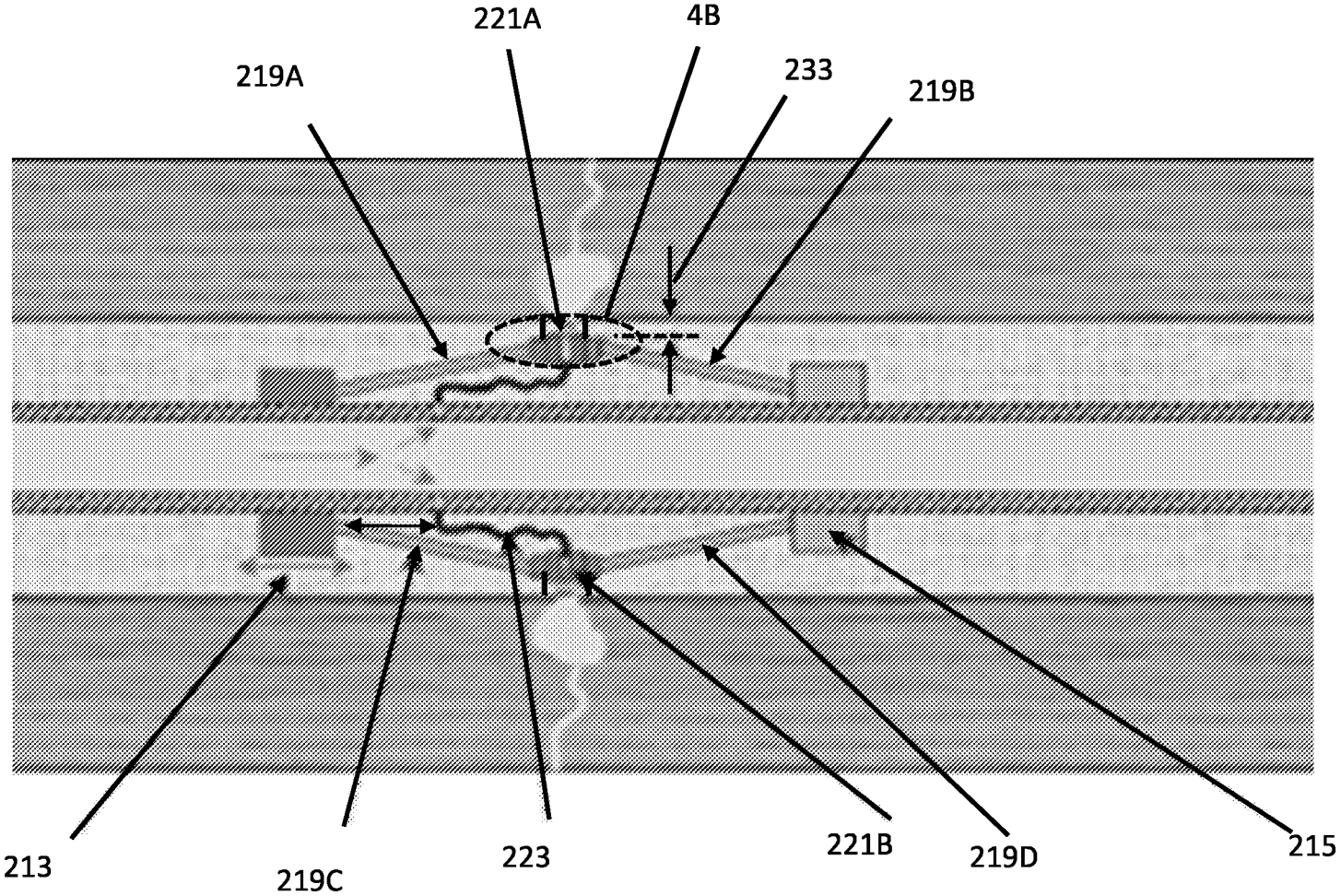
FIG. 4A is a schematic diagram of another illustrative downhole tool for matrix acidizing a subterranean rock formation according to an embodiment of the present disclosure.
Figure 4B:
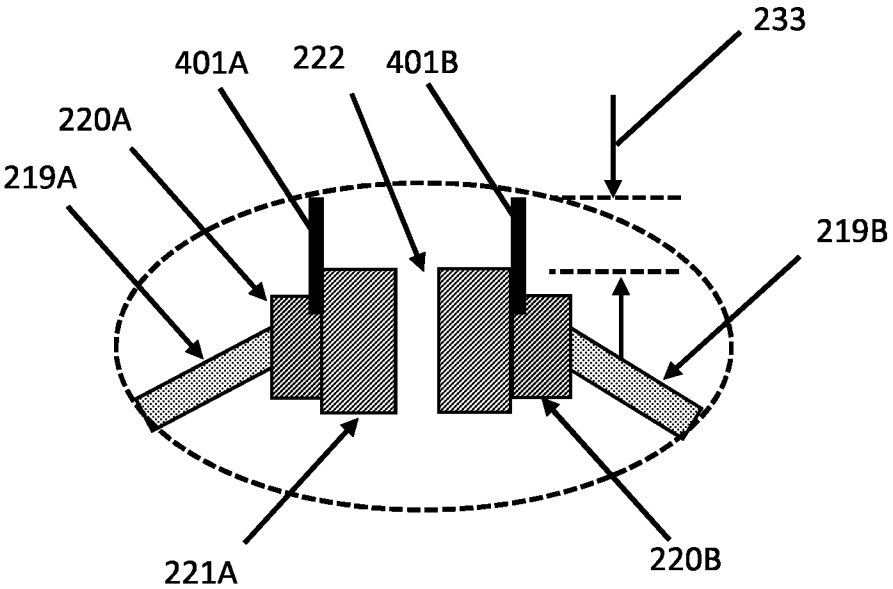
FIG. 4B is a zoomed-selected view of part of the downhole tool of FIG. 4A.

In another embodiment, the end(s) of the one or more arms that support a nozzle (or the nozzle itself) can be equipped with a rod (or other element) that extends radially beyond the exit of the nozzle and contacts the wellbore surface. In this configuration, the rod (or other element) can aid in positioning the nozzle at the desired standoff from the wellbore surface. In embodiments, the radial length of the rod (or other element) can be fixed, or adjustable and adjusted at the surface, to provide the desired standoff for a particular job. This desired standoff can depend on jetting rate, nozzle orifice, acid type, formation type, etc., which can be evaluated during the job design. An example configuration that employs rods to aid in positioning the nozzle(s) of the BHA at the desired standoff from the wellbore surface is shown in FIGS. 4A and 4B. In this configuration, rod 401A extends from end 220A of arm 219A that supports nozzle 221A. The rod 401A extends radially outward away from the exit 222 of nozzle 221A. Similarly, rod 401B extends from end 220B of arm 219B that supports nozzle 221A. The rod 401B also extends radially outward away from the exit 222 of nozzle 221A. In this manner, the rods 401A, 401B are disposed on opposite sides of the nozzle 221A. The radial length of the rods 401A, 410B can be fixed, or adjustable and adjusted at the surface, to provide the desired standoff for a particular job. The standoff is shown with arrows and labeled 233 in FIG. 4B.

In other embodiments, the BHA can be configured with a jetting module that employs the sliding and the fixed bodies as well as the arms and nozzles, wherein the jetting module can rotate around the central axis of the BHA. As a result, a 360-degree matrix acidizing stimulation can be achieved.

In yet other embodiments, the BHA can employ several jetting modules that each employ the sliding and the fixed bodies as well as the arms and nozzles, where jetting modules are spaced axially from one another (e.g., in a series arrangement) along the tubular housing of the BHA to stimulate longer zones without moving the BHA and the tubing.

In still other embodiments, the BHA can be configured with a jetting module that employs the sliding and the fixed bodies as well as the arms and nozzles, where the jetting module can move axially relative to the central axis of BHA while jetting the stimulating fluid in contact with the surface of the wellbore.

Figure 5:
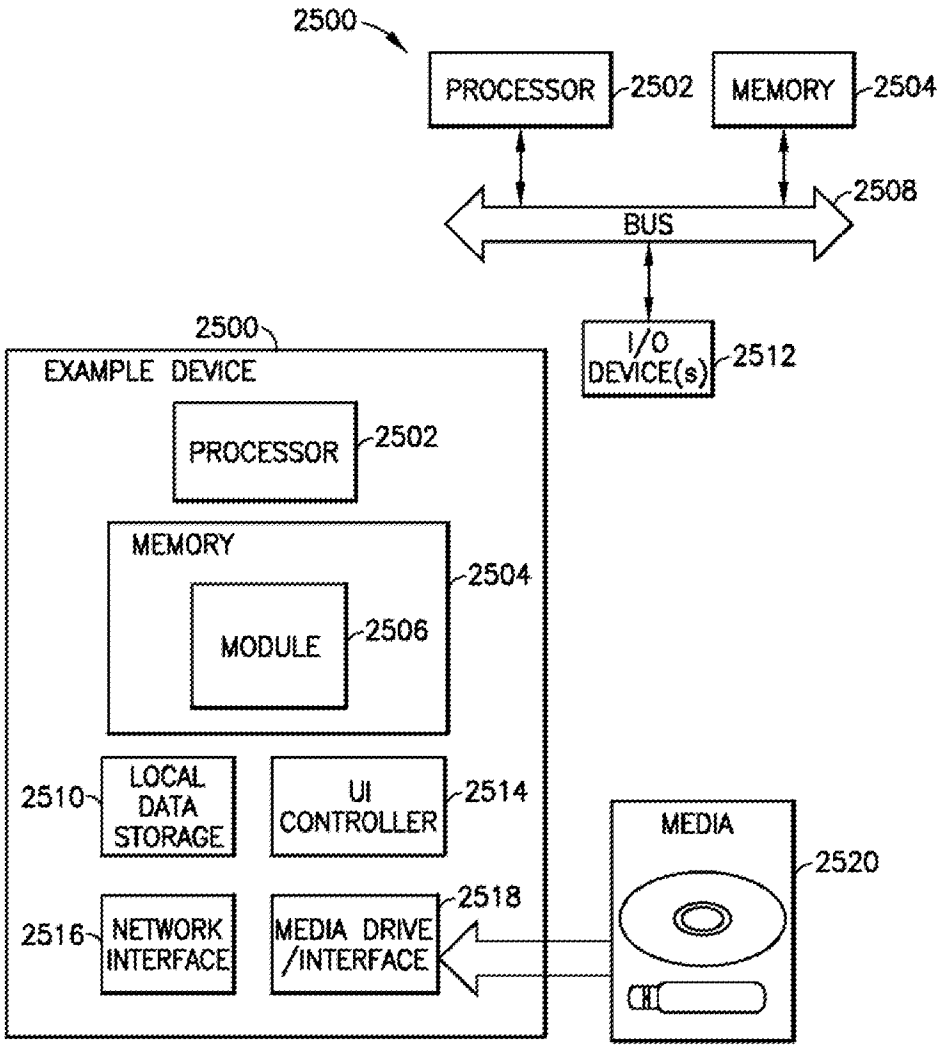
FIG. 5 illustrates a schematic view of a computing system according to an embodiment of the present disclosure.

FIG. 5 illustrates an example device 2500, with a processor 2502 and memory 2504 that can be configured to implement various embodiments of the methods and processes as discussed in the present application, including control of the standoff between the exit of one or more nozzles and the wellbore surface in the treatment zone during matrix acidizing as described herein. Memory 2504 can also host one or more databases and can include one or more forms of volatile data storage media such as random-access memory (RAM), and/or one or more forms of non-volatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various systems and processes of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Some of the methods and processes described above, can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Although only a few example embodiments have been described in detail above, those skilled in the art will readily appreciate that many modifications are possible in the example embodiments without materially departing from this invention.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A downhole tool deployable at a treatment zone in a wellbore that traverses a subterranean rock formation traversed by the wellbore, the downhole tool comprising:

a nozzle with an exit, the nozzle being supported via at least one moveable arm, wherein the nozzle is configured to inject a stimulating fluid into a near-wellbore area of the subterranean rock formation at a pressure below a formation fracturing pressure, wherein the nozzle is configured to direct a high-pressure flow of the stimulating fluid from the exit of the nozzle to a localized area of a wellbore surface in the treatment zone to form at least one wormhole arising from a dissolution of rock caused via a reaction of the rock with the stimulating fluid, wherein the at least one moveable arm is configured for controlled radial movement of the nozzle to provide an adjustable and variable standoff between the exit of the nozzle and the wellbore surface in the treatment zone, and wherein the nozzle and the at least one moveable arm are part of a jetting module that is configured to move axially relative to a central axis of the downhole tool.

2. The downhole tool according to claim 1, further comprising flexible tubing that is external to the at least one moveable arm and configured to carry the stimulating fluid to the nozzle.

3. The downhole tool according to claim 1, further comprising packers spaced apart from one another and configured to isolate the treatment zone.

4. The downhole tool according to claim 1, wherein the downhole tool is conveyed via coiled tubing.

5. The downhole tool according to claim 1, further comprising a sliding body that is operably coupled to the at least one moveable arm, wherein linear translation of the sliding body drives pivoting movement of the at least one moveable arm that produces radial movement of the nozzle to provide the adjustable and variable standoff between the exit of the nozzle and the wellbore surface in the treatment zone.

6. The downhole tool according to claim 5, wherein the linear translation of the sliding body is adjusted via electromechanical operation or hydraulic operation.

7. The downhole tool according to claim 6, wherein the electromechanical operation or the hydraulic operation of the downhole tool that adjusts the linear translation of the sliding body is controllable via electric power cables or hydraulic lines that extend from a surface facility to the downhole tool via tubing.

8. The downhole tool according to claim 6, wherein the nozzle and the at least one movable arm are supported on a tool housing, and the electromechanical operation or the hydraulic operation of the downhole tool that adjusts the linear translation of the sliding body is powered via a battery enclosed via the tool housing and controlled via signals communicated over a fiber optic cable that extends from a surface facility to the downhole tool via tubing.

9. The downhole tool according to claim 6, wherein the downhole tool is configured to employ pressure that results from supply of the stimulating fluid to the downhole tool as a pressure source for the hydraulic operation of the downhole tool that adjusts the linear translation of the sliding body.

10. The downhole tool according to claim 1, wherein the at least one moveable arm or the nozzle comprises a rod or other element that extends radially beyond the exit of the nozzle and contacts the wellbore surface, wherein a radial length of the rod or the other element sized to provide desired standoff for a particular operation.

11. The downhole tool according to claim 1, wherein:

the nozzle is one of a plurality of nozzles supported via the at least one moveable arm, wherein each nozzle of the plurality of nozzles is configured to direct the high-pressure flow of the stimulating fluid from the exit of the nozzle to the localized area of the wellbore surface to create a plurality of wormholes arising from the dissolution of the rock caused via the reaction of the rock with the stimulating fluid, and the at least one moveable arm is configured for the controlled radial movement to provide the adjustable and variable standoff between the exits of the plurality of nozzles and the wellbore surface in the treatment zone.

12. The downhole tool according to claim 11, wherein the plurality of nozzles is supported via a plurality of moveable arms.

13. The downhole tool according to claim 1, wherein the jetting module rotates about the central axis of the downhole tool to achieve 360-degree matrix acidizing stimulation.

14. The downhole tool according to claim 1, wherein the nozzle and the at least one moveable arm are part of several jetting modules that are spaced axially from one another along a tubular housing of the downhole tool.

15. A method for stimulating recovery of hydrocarbons from a subterranean rock formation traversed by a wellbore, comprising:

deploying the downhole tool according to claim 1 at a treatment zone of the wellbore;

configuring the at least one moveable arm of the downhole tool for the controlled radial movement of the nozzle to provide a desired standoff between the exit of the nozzle and the wellbore surface in the treatment zone; and operating the downhole tool to supply the stimulating fluid to the treatment zone at a pressure less than formation breakdown pressure, wherein the nozzle directs the high-pressure flow of the stimulating fluid from the exit of the nozzle to the localized area of the wellbore surface in the treatment zone to form the at least one wormhole arising from the dissolution of the rock caused via the reaction of the rock with the stimulating fluid.

16. The method according to claim 15, wherein the stimulating fluid comprises an acid component.

17. A downhole tool deployable at a treatment zone in a wellbore that traverses a subterranean rock formation traversed by the wellbore, the downhole tool comprising:

a tool housing defining a central channel configured to receive a stimulating fluid;

at least one moveable arm configured to move relative to the tool housing;

a nozzle with an exit, the nozzle being supported on the at least one moveable arm; and flexible tubing that is external to the at least one moveable arm, wherein the flexible tubing connects the central channel to the nozzle and is configured to carry the stimulating fluid to the nozzle, wherein a flexibility of the flexible tubing facilitates free motion of the at least one moveable arm relative to the tool housing, wherein the nozzle is configured to inject the stimulating fluid into a near-wellbore area of the subterranean rock formation at a pressure below a formation fracturing pressure, wherein the nozzle is configured to direct a high-pressure flow of the stimulating fluid from the exit of the nozzle to a localized area of a wellbore surface in the treatment zone to form at least one wormhole arising from a dissolution of rock caused via a reaction of the rock with the stimulating fluid, and wherein the at least one moveable arm is configured for controlled radial movement of the nozzle to provide an adjustable and variable standoff between the exit of the nozzle and the wellbore surface in the treatment zone.

18. The downhole tool of claim 17, wherein the nozzle and the at least one moveable arm are part of a jetting module that is configured to move axially relative to a central axis of the downhole tool.

* * * * *